US006301914B1

(12) United States Patent
Oliva et al.

(10) Patent No.: US 6,301,914 B1
(45) Date of Patent: Oct. 16, 2001

(54) ROOM AIR CONDITIONER HAVING OUTDOOR POWER CORD

(75) Inventors: Jose G. Oliva; Victoriano Zamora; Nestor Hernandez, all of Nuevo Leon (MX)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/641,231

(22) Filed: Aug. 17, 2000

(51) Int. Cl.[7] ..... F25D 23/12
(52) U.S. Cl. ..... 62/262; 62/263
(58) Field of Search ..... 62/262, 263, 298, 62/236, 237, 258.1

(56) References Cited

U.S. PATENT DOCUMENTS 3,973,939 * 8/1976 Abbott ..... 62/237
5,205,130 * 4/1993 Pannell ..... 62/236

* cited by examiner

*Primary Examiner*—Henry Bennett
*Assistant Examiner*—Chen-Wen Jiang

(57) ABSTRACT

An electrical power cord arrangement for a room air conditioner of the type having an indoor section, an outdoor section, an electrical control box contained within the indoor section and an outer housing partially enclosing both sections. The outer housing has an access opening therein in the region thereof which encloses the outdoor section. An electrical power cord having a first end, which terminates within the electrical control box extends from the control box, through the housing, into the outdoor section of the air conditioner where it then passes from the housing through the access opening to the exterior thereof, where it terminates in a second end configured to be connected to a source of electrical power.

5 Claims, 3 Drawing Sheets

ROOM AIR CONDITIONER HAVING OUTDOOR POWER CORD

BACKGROUND OF THE INVENTION

The present invention is directed to air conditioners and, more particularly, to a room air conditioning unit having a power cord extending from the outdoor section of the air conditioner.

Air conditioning units such as so-called "window room air conditioners" are commonly used for residential and similar applications and generally include closed refrigeration circuits having an evaporator and a condenser. The unit is normally divided by a partition into an evaporator section and a condenser section. The evaporator section communicates with the room air to be conditioned and the condenser section communicates with external air such as outdoor air. Refrigerant flows through a refrigerant circuit absorbing heat from room air at the evaporator and discharging heat energy to the external air at the condenser. The conventional refrigeration circuit is completed by the addition of a compressor, an expansion device, and the appropriate connections between the components.

Such an air conditioning unit usually includes a basepan supporting all of the components and an outer housing surrounding the entire unit. The front of the evaporator, or indoor section, includes an indoor grille, which has openings therein for directing warm indoor air into the evaporator and discharge openings therein for directing air back into the room. The outdoor section of the housing includes a plurality of openings in the sides and top thereof, which serve as inlet openings for cooling air which flows into the outdoor section and outwardly therefrom after passing through the condenser coil, which is mounted vertically in the back of the outdoor section.

The indoor grille also includes an opening therein for the control panel upon which are mounted control knobs, buttons, switches, and the like for facilitating adjustment of the air conditioning unit's function and temperature output. The control panel and the control components associated therewith are typically mounted to a control box for the unit in which are housed other components associated with the electrical system of the air conditioning unit. The electrical power cord for such units is usually connected to an electrical plug or an electrical circuit in an interior wall of the room which is being conditioned and, accordingly, the end of the cord providing power to the unit usually passes through an opening in the indoor grille and into the control box.

In some applications and in some countries, room air conditioners are mounted in a manner in which it is desired to plug the unit into an electrical outlet provided outside of the room being conditioned in close proximity to the outdoor section of the air conditioner.

SUMMARY OF THE INVENTION

An electrical power cord arrangement for a room air conditioner of the type having an indoor section, an outdoor section, an electrical control box contained within the indoor section and an outer housing partially enclosing both sections. The outer housing has an access opening therein in the region thereof which encloses the outdoor section. An electrical power cord having a first end, which terminates within the electrical control box extends from the control box, through the housing, into the outdoor section of the air conditioner where it then passes from the housing through the access opening to the exterior thereof, where it terminates in a second end configured to be connected to a source of electrical power.

BRIEF DESCRIPTION OF THE DRAWINGS

The invention may be better understood and its objects and advantages will become apparent to those skilled in the art by reference to the accompanying drawings, in which.

DESCRIPTION OF THE PREFERRED EMBODIMENTS

Figure 1:
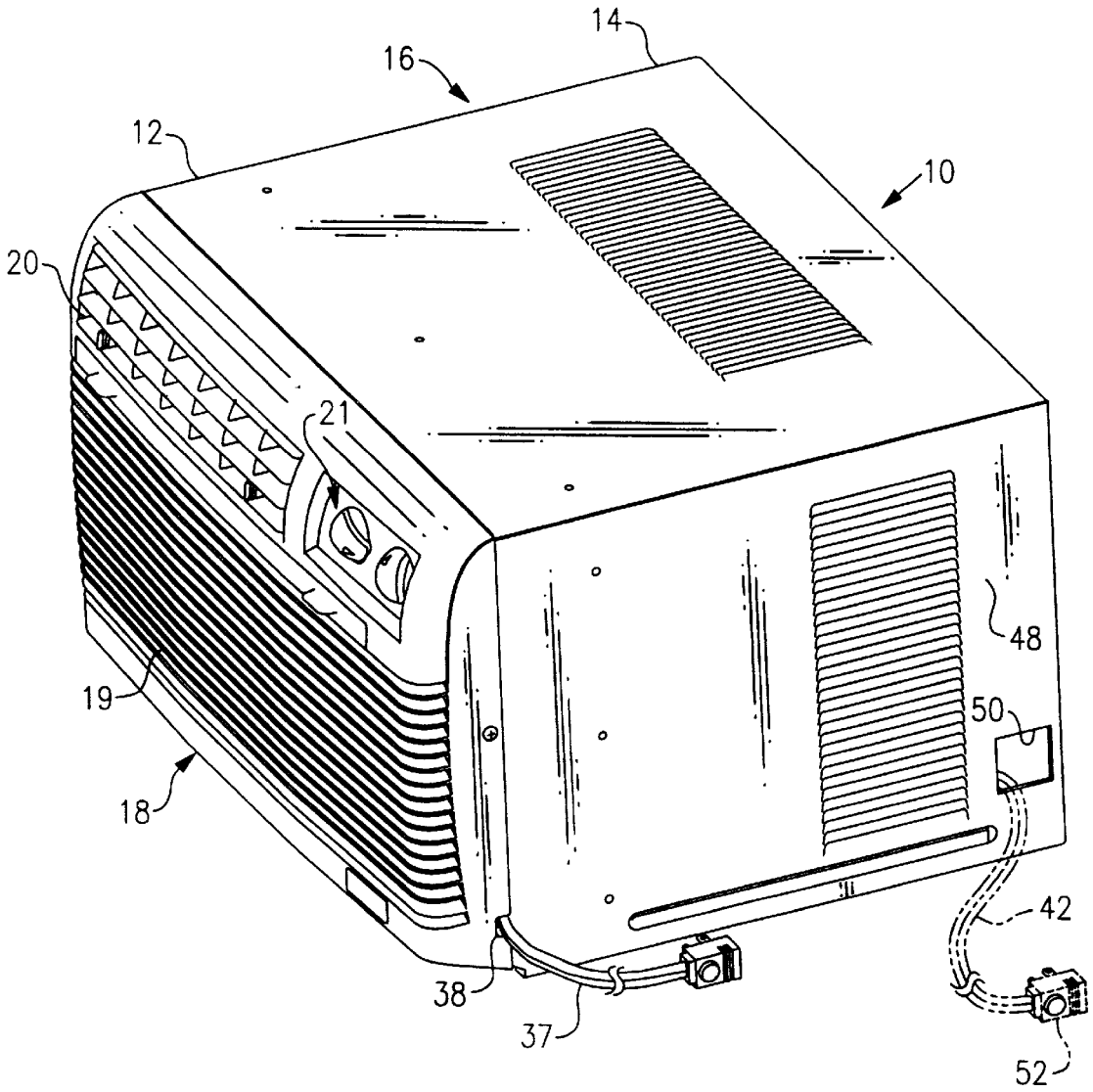
FIG. 1 is a perspective view of a room air conditioner illustrating a power cord arrangement for an indoor application and for an outdoor application.

FIG. 1 illustrates an air conditioner 10, which includes generally an indoor section 12 and an outdoor section 14. The air conditioner is enclosed in a substantially rectangular housing 16 and is adapted to be positioned in a rectangular opening in an exterior wall or in a window in a room where cooling is desired, with the indoor section 12 facing into the room, as is conventional. The indoor section 12 includes an indoor grille section 18, which includes inlet louvers 19 and an air discharge assembly 20. The front grille 18 also includes a control panel 21 in the upper right-hand corner, which forms the front wall of a control box mounted in the indoor section. Looking now at FIGS. 2 and 3, the components of both the indoor section 12 and outdoor section 14 are supported in a rectangular basepan 24. The indoor and outdoor sections are separated by a vertically extending metal partition 26. The indoor section includes an evaporator coil (not shown) vertically disposed at the front end thereof and an evaporator or indoor fan (not shown) located behind the evaporator.

The outdoor section 14 includes a condenser coil 28 vertically disposed adjacent the back end thereof and a condenser fan (not shown) located within the outdoor section adjacent the condenser coil. The unit's compressor 30 is also located in the outdoor section 14. The condenser coil 28 is fluidly interconnected with the compressor 30 and the evaporator in a conventional manner to provide cooling to the room in which the unit is installed.

During operation, air from the space to be conditioned by the unit is drawn by action of the evaporator fan through the inlet louvers 19 and is directed through the evaporator coil where the air is cooled. The cooled air is then directed back into the room to be cooled through the air discharge assembly 20. At the same time, ambient air is drawn through inlets 32 in the outside section of the housing 16 by operation of the condenser fan and is directed through the condenser coil 28 before exiting from the back side thereof.

Figure 2:
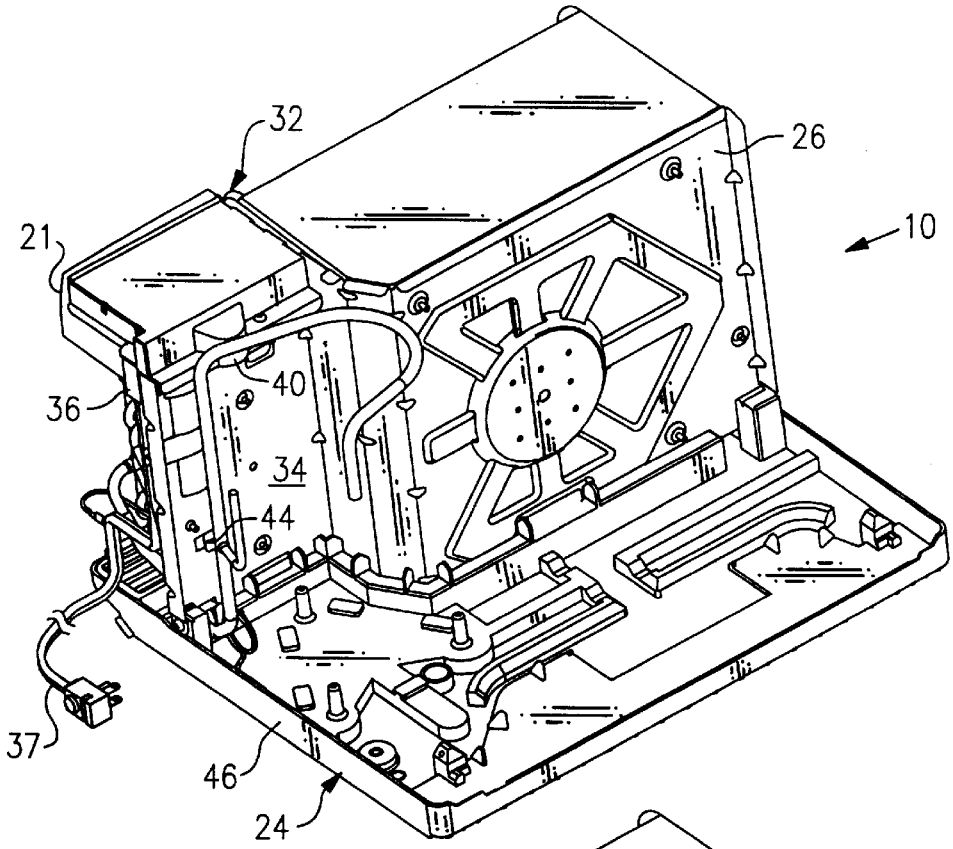
FIG. 2 is a rear perspective view of the air conditioner of FIG. 1 with an indoor power cord arrangement.
Figure 3:
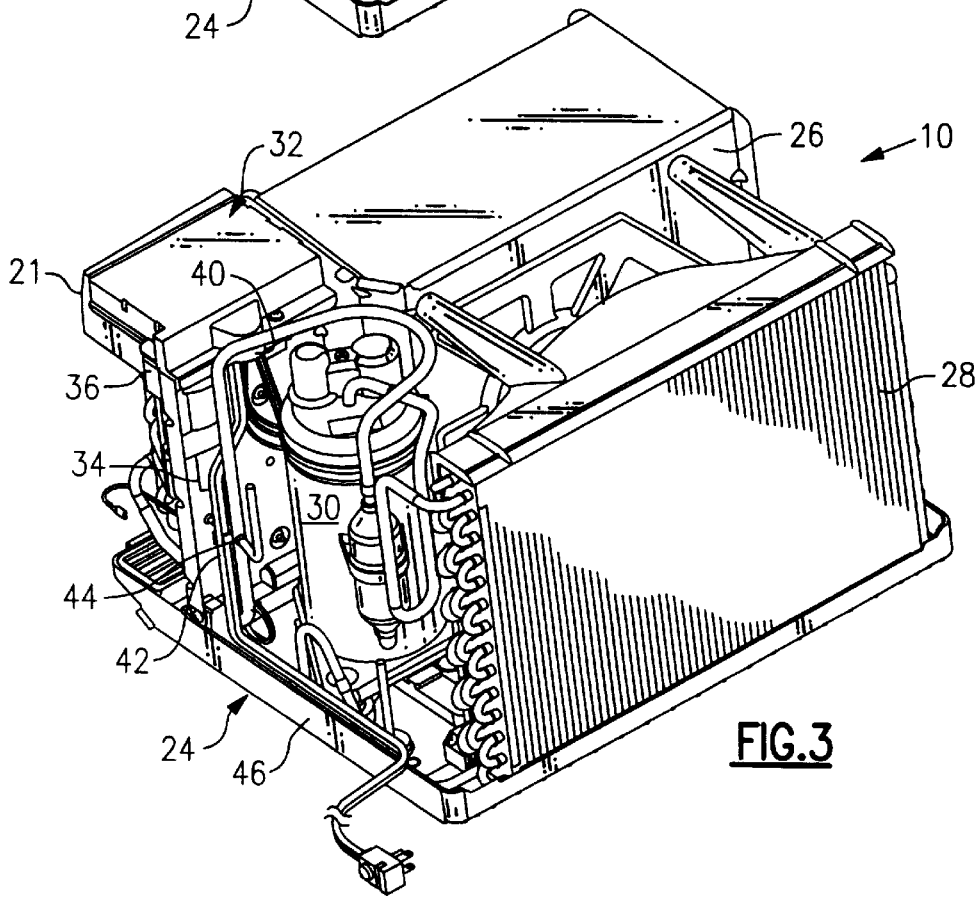
FIG. 3 is a view similar to FIG. 2 with an outdoor power cord arrangement.
Figure 4:
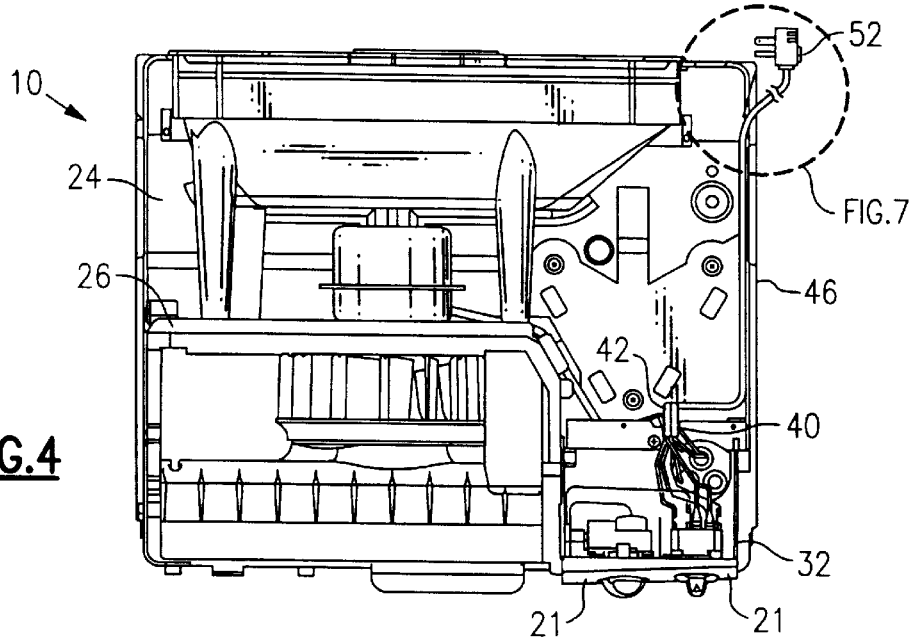
FIG. 4 is a top plan view of an air conditioner having an outdoor power cord arrangement with a portion of the housing and other components removed to show the details thereof.
Figure 5:
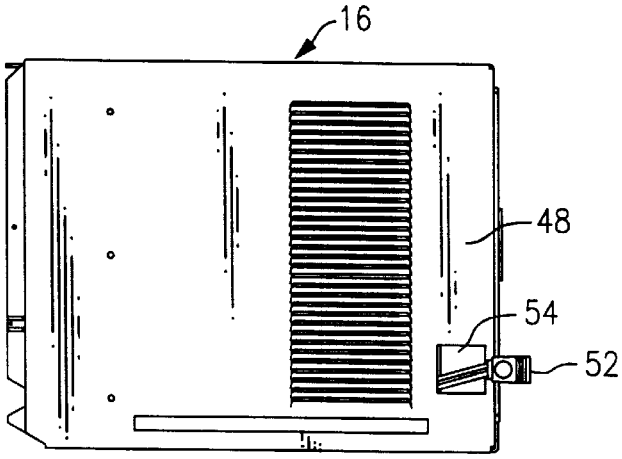
FIG. 5 is a side view of an air conditioner housing for an outside power cord arrangement.

As best seen in FIGS. 2, 3 and 4, the control panel 21 forms a part of a control box 32, which is attached to a planar section 34 of the metal partition 26. The control box 32 is provided with a first covered opening 36 on the right-hand side thereof (viewed from the front) through which an electrical power cord 38 extends in a conventional fashion to provide electrical power to the components within the control box. In such an application, as illustrated in FIG. 1, the power cord passes from the exterior of the air conditioner through an opening 38 in the indoor grille 18 and thence through the covered opening 36 to the interior of the control box 32.

The control box 32 has a second covered opening 40 formed on the back side thereof above a planar section 34 of the partition through which electrical wiring to the components mounted in the outdoor section extend.

As best seen in FIGS. 3 and 4, when the air conditioner is assembled with the outside power cord according to the present invention, the power cord 42 passes into the control box 32 through the back opening 40 thus extending from the outdoor section above the partition 34/26 and into the control box. From the back opening 40, the electrical power cord 42 extends downwardly parallel to the back side of the planar section 34 where it passes through a metal retaining clip 44 formed in the planar section 34 of the partition. From the clip 44 the cord runs downwardly to the basepan 24 and thence rearwardly parallel to a side wall 46 of the basepan to the region adjacent the right end of the condenser coil 28.

Figure 6:
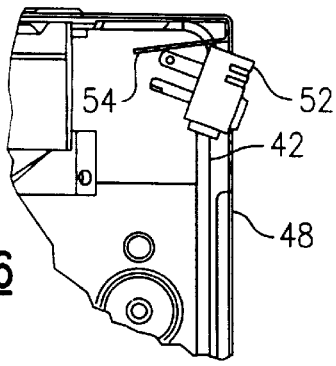
FIG. 6 is an enlarged view of the corner of the air conditioner similar to that illustrated in FIG. 4 illustrating installation of the outdoor power cord.
Figure 7:
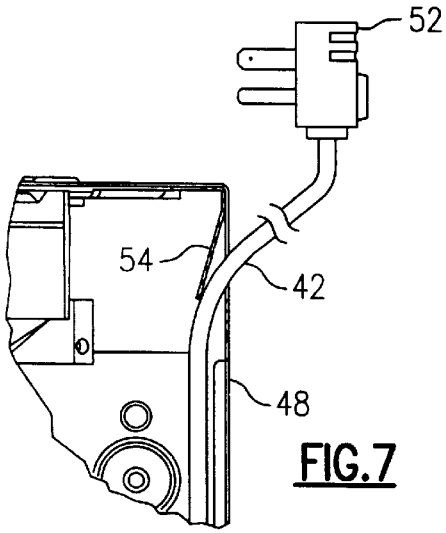
FIG. 7 is an enlarged showing of the region identified in FIG. 4 as FIG. 7.

Looking now at FIGS. 1 and 4–7, the right-hand side wall 48 of the housing 16 is provided with a rectangular opening 50 in the lower rear portion thereof. As seen in FIG. 6, the opening 50 is sized to allow an electrical plug 52 carried on the power cord 42 to pass therethorugh during assembly of the air conditioning unit. The opening 50 in the wall 48 is formed by separating by three contiguous sides from the perimeter of the opening an leaving a hinged section 54, which may be bent rearwardly, as illustrated in FIGS. 6 and 7, to allow passage of the plug and power cord through opening 50 during assembly. Following assembly, the hinged section 54 may then be bent forwardly, as illustrated in FIG. 7, to further restrain the cord 42 and to limit access to the interior of the housing through the opening 50.

Accordingly, the air conditioning unit of the present invention may be provided with a conventional indoor power cord arrangement or with an outdoor power cord arrangement, depending on where the electrical power is available in a particular installation. In the preferred embodiment, the section of material that is bent out of the way to provide the opening 50 is formed in the sheet metal such that access is not available to the opening 50 when an indoor cord is used. The three sides described hereinabove are formed such that they may be readily separated from the surrounding sheet metal by application of a mechanical force to allow the cover to pivot about the one solid side described hereinabove. Accordingly, the air conditioner in the preferred embodiment may be manufactured on the assembly line with an indoor cord arrangement with the understanding the cord may be routed, as described hereinabove, to provide the optional outdoor cord arrangement.

What is claimed is:

1. A room air conditioner of the type having an indoor section, an outdoor section, an electrical control box contained within the indoor section, and an outer housing partially enclosing both sections, wherein the improvement comprises:

said outer housing having an access opening therein in the region thereof which encloses the outdoor section;

an electrical power cord having a first end thereof terminating within said electrical control box, said power cord extending from said control box, through said housing, into said outdoor section of said air conditioner, and passing from said housing through said access opening to the exterior thereof where it terminates in a second end thereof.

2. The room air conditioner of claim 1 including a basepan underlying said indoor and outdoor sections and a partition support ed at its lower end by said basepan and separating s aid indoor an d outdoor sect ions, said control box being mounted on the indoor side of said partition adjacent the upper end thereof, said power cord extending through said partition and downwardly adjacent the outdoor side of said partition; and cord retaining structure formed on said outer side of said partition configured to engage and retain said power cord adjacent said partition.

3. The room air conditioner of claim 1 wherein said outer housing is made from sheet metal and said access opening is a rectangular opening formed by separating three sides of a rectangular panel from said sheet metal housing, the fourth side of said rectangular panel forming a hinge to allow movement of said panel to positions opening and closing said access opening.

4. The room air conditioner of claim 3 including an electrical power plug attached to said second end of said power cord, and wherein said access opening is large enough to allow passage of said power plug therethrough.

5. The room air conditioner of claim 1 wherein said electrical control box is configured to optionally allow said second end of said power cord to extend therefrom within said indoor section of said air conditioner.

* * * * *